United States Patent [19]

Koerner et al.

[11] 4,248,590

[45] Feb. 3, 1981

[54] PREPARATION FOR SHRINKPROOFING WOOL

[75] Inventors: Götz Koerner; Günter Schmidt; Friedhelm Nickel, all of Essen, Fed. Rep. of Germany

[73] Assignee: Th. Goldschmidt AG, Essen, Fed. Rep. of Germany

[21] Appl. No.: 20,024

[22] Filed: Mar. 13, 1979

[30] Foreign Application Priority Data

Mar. 16, 1978 [GB] United Kingdom ..... 10551/78

[51] Int. Cl.[3] ..... D06M 15/66; D06M 3/00; D06M 13/26; C08L 83/08

[52] U.S. Cl. ..... 8/128 A; 8/115.6; 8/DIG. 1; 252/8.6; 252/8.7; 260/29.2 M; 528/10; 528/30; 528/40

[58] Field of Search ..... 252/8.6, 8.7; 8/115.6, 8/128 A, DIG. 1; 260/29.2 M, 448.8 R; 528/30

[56] References Cited

U.S. PATENT DOCUMENTS

| | | | |
|---|---|---|---|
| 3,832,228 | 8/1974 | Gardiner | 8/128 A |
| 3,876,459 | 4/1975 | Burrill | 8/128 A |
| 3,910,026 | 10/1975 | Sone et al. | 428/365 |
| 4,005,231 | 1/1977 | Smith | 528/29 |
| 4,098,572 | 7/1978 | Smith | 8/128 A |
| 4,101,272 | 7/1978 | Guise et al. | 8/DIG. 1 |
| 4,137,179 | 1/1979 | Koerner et al. | 260/29.2 M |
| 4,177,176 | 12/1979 | Burrill et al. | 260/29.2 M |
| 4,182,682 | 1/1980 | Koerner et al. | 8/115.6 |

FOREIGN PATENT DOCUMENTS

| | | | |
|---|---|---|---|
| 2645954 | 4/1977 | Fed. Rep. of Germany | 8/DIG. 1 |

*Primary Examiner*—Joseph L. Schofer
*Assistant Examiner*—Herbert J. Lilling
*Attorney, Agent, or Firm*—Toren, McGeady and Stanger

[57] ABSTRACT

A preparation for shrinkproofing wool composed of 1 to 50 weight percent of organopolysiloxanes composed of 90 to 99.8 mole % of units having the formula $R_n^1SiO_{(4-n)/2}$, and 0.2 to 10 mole % of units having the formula $R^2SiO_{3/2}$ with the remainder being water and other conventional additives. These preparations provide emulsions which are stable over long periods of time, do not precipitate even in the presence of moisture, provide durable shrinkproof properties to wool, and have no adverse effect on the "hand" of the wool.

7 Claims, No Drawings

PREPARATION FOR SHRINKPROOFING WOOL

BACKGROUND OF THE INVENTION

1. Field of the Invention

The invention relates to a preparation for shrinkproofing wool based on organopolysiloxanes.

2. Description of the Prior Art

It is well-known that wool in the untreated state shrinks and felts when washed in an aqueous liquor. In order to counteract this shrinkage and felting, chemical treatments have been recommended in which the structure of the wool is changed or in which finishes are used which contain resin that deposits on the surface of the wool fibers so as to envelop them. By both processes, however, products are obtained whose so-called "hand" is regarded as unpleasant by the consumer.

It has also been disclosed that the shrinkage of wool on washing can be decreased by treatment with organosilicon compounds. Such processes are described in British Pats. Nos. 594,901, 613,267, and 629,329, wherein the wool is treated with certain silanes.

A process for preventing the shrinkage of wool is described in British Pat. No. 746,307, in which the wool fibers are finished with certain organopolysiloxanes. While some degree of shrinkproofness can be achieved by these means, the effect does not stand up to laundering.

In a series of further publications, for example, German Offenlegungsschriften Nos. 22 42 297, 23 35 751, and 25 23 270, processes are disclosed for shrinkproofing keratin fibers by applying organopolysiloxanes, an essential characteristic of these processes residing in the amino-group content of these compounds.

For example, the process according to German Offenlegungsschrift No. 22 42 297 is characterized by the fact that units of the general formula $$R_n^5SiO_{(4-n)/2}$$

are used as organopolysiloxanes, in which:

n has an average value of 1.9 to 2.1, and $R^5$ is an organic residue which is linked to silicon by a silicon-carbon bond wherein 0.25 to 50% of the $R^5$ substituents are monovalent residues with fewer than 30 carbon atoms which contain at a distance of at least 3 carbon atoms from the silicon atom:

at least 1 imino group, and at least 1 primary or secondary amino group having the formula $—NX_2$ wherein X is a hydrogen atom, an alkyl group with 1 to 30 carbon atoms or an aryl group, and wherein the remaining $R^5$ substituents are monovalent hydrocarbon residues, halogenated hydrocarbon residues, carboxyalkyl residues or cyanoalkyl residues with 1 to 30 carbon atoms, of which at least 70% consist of monovalent hydrocarbon residues with 1 to 18 carbon atoms.

A process for treating keratin fibers is known from German Offenlegungsschrift No. 23 35 751, which is characterized by the fact that the organopolysiloxane composition contains the product obtained by mixing components (A) and (B) wherein A is a polydiorganosiloxane with terminal hydroxy groups linked to silicon atoms and with a molecular weight of at least 750, in which at least 50% of the organic substituents of the polydiorganosiloxane are methyl groups and in which the other substituents are monovalent hydrocarbon groups with 2 to 30 carbon atoms, and B is an organosilane of the general formula $$R^6SiR_n^7X_{3-n}$$

in which $R^6$ is a monovalent group which is built up from carbon, hydrogen, nitrogen and, optionally, oxygen, contains at least 2 amino groups and is linked to silicon through silicon-carbon bonds, $R^7$ is an alkyl group or an aryl group, X is an alkoxy group with 1 to 4 carbon atoms inclusive, and n is 0 or 1, and/or a partial hydrolysate and condensate of the organosilane.

It is stated in this German Offenlegungsschrift that the two components of the mixture should be reacted if the fibers are to be treated from an aqueous medium. As practical experiments have shown, however, it is not possible to prepare stable, aqueous emulsions from such reaction products. Gel-like reaction products are formed which cannot be transformed into emulsion form. They are therefore not suitable for shrinkproofing wool from an aqueous phase.

If these reaction products are used in the form of organic solutions, the effect which can be achieved turns out to be too slight for them to be successfully used under practical conditions. Moreover, through the action of moisture from the air, a siloxane gel precipitates from the solvent-containing liquor and clogs up the equipment for treating the wool.

Furthermore, a process is known from German Offenlegungsschrift No. 17 69 249 for treating fibrous materials, e.g., wool, in which organosiloxanes containing mercaptopropyl groups are used in the form of an emulsion. With these compounds, however, it is only possible to decrease the soilability. The compounds are not suitable for making wool shrinkproof.

In another process, a hair-treating material is known from German Offenlegungsschrift No. 16 17 443, which is based on organosilicon compounds and characterized by the fact that it contains an organosiloxane copolymer of the general formula

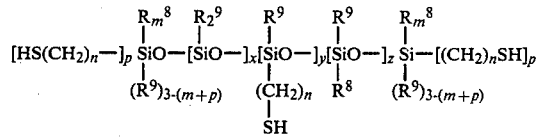

in which $R^8$ represents alkyl residues with at least 8 carbon atoms, $R^9$ represents lower alkyl residues with 1 to 7 carbon atoms, n is a whole number not less than 2, p is 0, 1 or 2, m is 0, 1 or 2, the sum of m+p has a value of 0 to 2, x is a whole number not less than 1, y and z in each case are 0 or a whole number, with the proviso than when y=0, p is at least 1 and when z=0, m is at least 1 and x is greater than the sum of y+z.

These compounds also are not suitable for shrinkproofing wool. The structure of an organopolysiloxane, which is suitable for shrinkproofing wool, could not be derived from these prior publications.

SUMMARY OF THE INVENTION

We have discovered a preparation for shrinkproofing wool, which contains, in emulsion form as well as in the form of an organic solution, compounds which are suitable for making wool shrinkproof which property is retained even after repeated washing of the wool in conventional washing machines. With the preparation of the present invention, the active material does not precipitate even in the presence of moist air and it is stable over a prolonged period even in the form of an emulsion. At the same time, the active material contained in the preparation does not have an adverse effect on the so-called "hand" of the wool or of knitted or woven materials prepared from the wool.

The preparation of the present invention comprises:

(a) 1 to 50 wt % of organopolysiloxanes, which consist of (aa) 90 to 99.8 mole % of units of the formula $$R_n^1SiO_{(4-n)/2} \quad (I)$$

in which $R^1$ is a methyl residue, of which, however, up to 10 mole % may be replaced by longer chain alkyl residues with at most 18 carbon atoms or aryl residues and in which up to 10 mole % of the methyl residues may be replaced by anionic groups which are linked through carbon atoms to the silicon atom, n has a value of 1.8 to 2.0, and (ab) 0.2 to 10 mole % of units of the formula $$R^2SiO_{3/2} \quad (II)$$

in which $R^2$ is an alkyl residue and/or a mercaptoalkyl or mercaptoaryl residue and/or a hydrogen residue and/or $O_{0.5}$ and/or an anionic group linked through carbon atoms to the silicon atom, in which up to 10 mole % of the oxygen atoms linked to silicon may each be replaced by two $OR^3$ groups, in which $R^3$ is a lower alkyl residue and/or hydrogen residue and wherein the organopolysiloxanes, consisting of (aa) and that they have at least one anionic group and contain 10 to 500 silicon atoms per anionic group, and (b) 50 to 99 wt % of water, optionally with emulsifiers and/or organic solvents and, optionally, customary additives.

Such customary additives are, for example, flame retardents.

DESCRIPTION OF THE PREFERRED EMBODIMENTS

In the case of the structure units I, the $R^1$ residue usually is a methyl residue. However, up to 10 mole % of the methyl residues may be replaced by longer chain alkyl residues with at most 18 carbon atoms or aryl residues. Examples of such residues are the ethyl, propyl, dodecyl or phenyl residue.

In addition, up to 10 mole % of the methyl residues may furthermore be replaced by anionic groups linked to the silicon atom through carbon atoms. The carbon chain of the bivalent hydrocarbon residue may be interrupted by oxygen, nitrogen or sulfur atoms. Anionic groups particularly suitable for use are $-R^4O_mSO_3^-$,

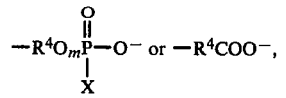

wherein m is 0 or 1 and X is a $-O^-$residue or the $-OR^3$ group. These anionic residues may be present in the form of free acids or they may be neutralized partially or completely.

The synthesis of organosilicon compounds which are modified by anionic groups is well-known to those skilled in the art. For instance, the $-R^4O_mSO_3^-$residue preferably is incorporated in the organopolysiloxane by reacting a sulfate of an organosilicon alcohol of the formula

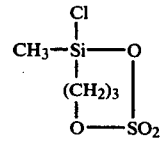

as described in German Pat. No. 14 45 363, with $\alpha,\omega$-polydimethylsiloxane diols in the presence of acid acceptors.

The esters of sulfuric acid may also be reacted with organic alcohols and the dialkoxysilanes so prepared, which are modified with sulfatopropyl groups, may be cocondensed with siloxanols in various ways, using, for example, even aqueous media.

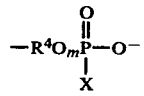

according to British Pat. No. 844,421, by the reaction of

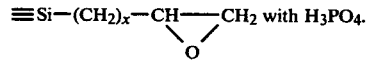

Anionic residues of the formula $-R^4COO-$are obtained by known procedures, for example, by saponifying $\equiv Si-R^4-CN$ or by hydrosilylating unsaturated carboxylic acids, for example, undecylenic acid, in the presence of suitable platinum compounds according to a process such as that described in German Pat. No. 11 65 028.

In the structure units of formula (I), the index n has a value of 1.8 to 2.0.

In structure unit (II)

$$R^2SiO_{3/2}$$

$R^2$ represents an alkyl residue, a mercaptoalkyl residue or a mercaptoaryl residue. $R^2$ may also be hydrogen residue or a partial oxygen residue $O_{0.5}$ or an anionic group linked to the silicon atom through carbon atoms. If several units of formula (II) are present, $R^2$ may have the same or different meanings in the various units. Here also, the methyl residue is preferred as the alkyl residue. Examples of alkyl and mercaptoalkyl or mercaptoaryl residues are the methyl, ethyl, mercaptomethyl, 2-mercaptoethyl, 3-mercaptopropyl or 4-mercaptophenyl residues.

Instead of polysiloxanes containing mercaptoalkyl or mercaptoaryl groups, it is also possible to use those polysiloxanes which convert to mercaptoalkyl or mercaptoaryl groups in the preparation. Examples of such mercapto precursors are the corresponding isothiouronium compounds:

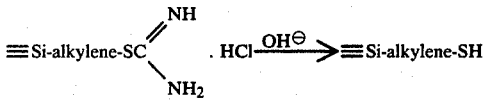

or the group of Bunte salts

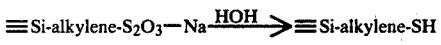

If these preliminary steps do not completely effect the conversion to the corresponding mercaptoalkyl or mercaptoaryl compounds, the remaining conversion takes place on the fiber.

In the structure units of formula II, up to 10 mole % of the oxygen atoms linked to silicon may each be replaced by two $OR^3$ groups, $R^3$ being a lower alkyl residue and/or a hydrogen residue. In such a case, these $—OR^3$ groups react in water or in moist air, splitting off $R^3OH$ and forming compounds in which, in each case, two $OR^3$ groups are replaced by one oxygen atom which links two silicon atoms to one another.

The siloxanes contained in the preparation must meet the requirement of having at least one anionic group and 10 to 500 silicon atoms per anionic group. Those siloxanes which contain 10 to 200 silicon atoms per anionic group are preferred.

Furthermore, the preparation preferably contains those polysiloxanes which are synthesized from 95 to 99.8 mole % of units (aa) and 0.2 to 5 mole % of (ab).

Furthermore, those polysiloxanes are preferred in which $R^2$ represents a mercaptoalkyl residue and in which all anionic groups are linked to the (aa) units.

The units I and II may be distributed statistically within the molecule. However, those organopolysiloxanes are preferred in which structure units I and II are arranged in blocks.

The organopolysiloxanes, contained in the inventive preparations, may, for example, have the following structure:

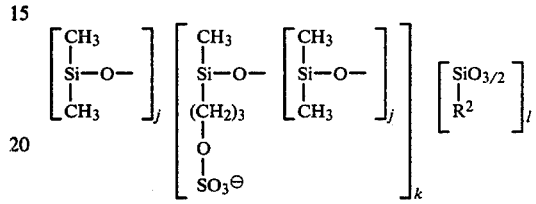

(III)

In formulating the preparation, those organopolysiloxanes are preferred, which are synthesized by the reaction of the sulfate or an organosilicon alcohol, such as is described in German Pat. No. 14 45 363, with α,ω-polydimethylsiloxanediol and the subsequent cocondensation with δ-mercaptoalkyl-trialkoxysilanes and/or δ-mercaptoalkyl-alkyldialkoxysilanes and/or alkyltrialkoxysilanes. The reaction may be described by the following equations.

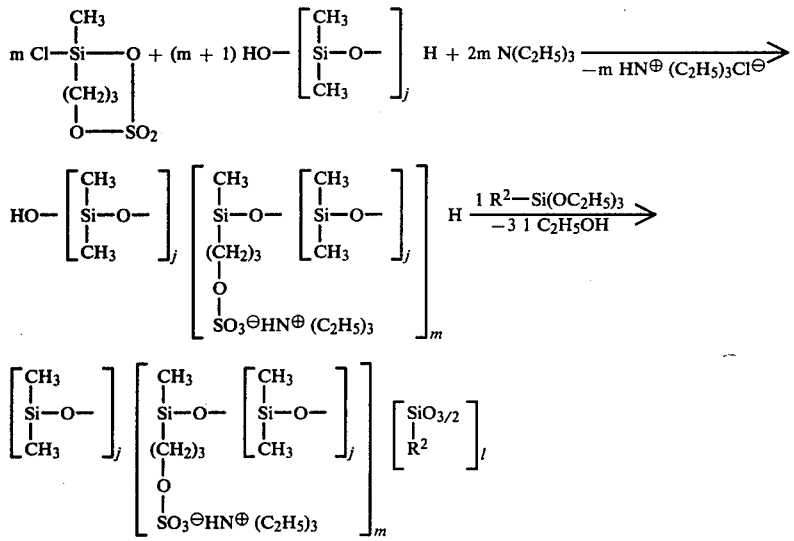

For small values of j and m, these products may be converted into emulsions simply by stirring them in water. From organosiloxanes of this type which are not self-emulsifying, stable, aqueous systems can be produced with suitable anionic or nonionic emulsifiers.

The preparation may also, however, exist in the form of an organic solution.

Suitable organic solvents are hydrocarbons and chlorinated hydrocarbons, for example, toluene, xylene, white spirite or 1,1,1-trichloroethane. Usually, however, the use of a preparation in the form of an aqueous emulsion is preferred.

The anionic organopolysiloxanes are substantive to wool and may be adsorbed from aqueous preparations by wool, which may be present in the form of fibers, yarns, woven fabrics or knitted fabrics. The material to be treated may also be dipped in the emulsion or solution and subsequently squeezed. The wool so treated is then dried or freed from solvent.

It is a particular advantage of the process that the organopolysiloxanes contained in the preparation, do not have to be fixed or set by a separate heat treatment. In the treated state, the wool should contain 0.3 to 5 and, preferably, 0.5 to 3% active material.

The following examples illustrate the present invention without limiting it.

EXAMPLE 1

A reaction vessel is charged with 200 ml of a suitable solvent, such as, methylene chloride and 29.2 g (0.135 moles) of a sulfate ester of an organosilicon alcohol of formula

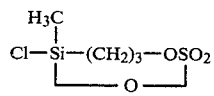

and a mixture of 200 g (0.27 moles) of $\alpha,\omega$-polydimethylsiloxanediol (j=9.6) and 30.45 g (0.3 moles) of triethylamine are added simultaneously from two dropping funnels with stirring at room temperature. In order to have a better control over the reaction, the reactants are diluted with methylene chloride to a volume of 400 ml. Stirring is continued for two hours after the addition. The reaction product is then mixed with 4.4 g (0.0185 moles) of 3-mercaptopropyltriethoxysilane and 13.59 g (0.076 moles) of methyltriethoxysilane, heated to 60° C. and stirred for a further two hours. Subsequently, the solvent is removed by a simple distillation.

The reaction product corresponds to the formula (III) in which j=9.6, m−1, and 1=0.7 and $R^2$ consists to the extent of 19.6 mole % of HS—$((H_2)_3$ residues and 80.4 mole % of $CH_3$ residues.

This results in an organopolysiloxane which is built up to the extent of 96.67 mole % of units of formula $$R_n^1SiO_{(4-n/2}$$

and 3.33 mole % of units of formula $$R^2SiO_{3/2}$$

At the same time, n has the value of 2, $R^1$ consists to 2.48 mole % of residues of formula —$(CH_2)_3OSO_3^{\ominus}$ and to 97.52 mole % of —$CH_3$ residues. $R^2$ has the above meaning. In this organopolysiloxane, there are 20.2 silicon atoms per anionic group.

This reaction product was freed from triethylammonium chloride by pressure filtration and, by being stirred with water, was converted into stable emulsions with 1.0 to 50% contents of active materials.

EXAMPLE 2

400 ml of methylene chloride were added to a reaction vessel along with 200 g (0.076 moles) of an $\alpha,\omega$-polydimethylsiloxandiol (j=35.1), 14.63 g (0.1448 moles) of triethylamine and these were mixed with 14.39 g (0.066 moles) of a sulfate or an organosilicon alcohol of formula

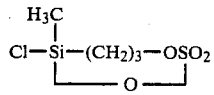

dissolved in 200 ml of methylene chloride which was added with stirring from a dropping funnel. Stirring was subsequently continued for two hours at room temperature. 3-mercaptopropyl-triethoxysilane (4.33 g, 0.0182 moles) were then added and the mixture was heated to 60° C. After a further two-hour period of stirring, the solvent was distilled off and the reaction product freed from triethylammonium chloride by pressure filtration.

The reaction product corresponds to the formula (III) in which j=35.1, m=7 and 1=1.93 and $R^2$ consists entirely of HS—$(CH_2)_3$-residues. This produces an organopolysiloxane which consists to 99.34 mole % of units having the formula.

$$R_n^1SiO_{(4-n)/2}$$

and to 0.66 mole % of units having the formula $$R^2SiO_{3/2}$$

At the same time, n has the value of 2, $R^1$ consists of 1.22 mole % of residues having the formula —$(CH_2)_3OSO_3^{\ominus}$ and 98.78 mole % of —$CH_3$ residues. $R^2$ has the above meaning.In this organopolysiloxane, there are 41.1 silicon atoms per anionic group.

A slight addition of i-propanol to the reaction product improves its dispersibility to such an extent that stable emulsions with siloxane contents of 1.0 to 50% can be produced simply by stirring into water.

EXAMPLE 3

As in Example 2, 200 g (0.0176 moles) of an $\alpha,\omega$-polydimethylsiloxanediol (j=153), 2.58 g (0.0255 moles) of triethylamine and 200 ml of methylene chloride are added to a suitable reaction vessel, stirred and mixed with 2.54 g (0.0117 moles) of a sulfate ester or an organosilicon alcohol having the formula

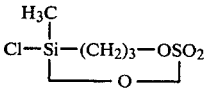

which is also dissolved in 200 ml of methylene chloride and added from a dropping funnel. After continuing the stirring for two hours, 4.29 g (0.018 moles) of 3-mercaptopropyltriethoxysilane are added to the solution which is then heated to 60° C. and stirred at this temperature for a further two hours. Subsequently, the solvent is removed by distillation and the triethylammonium chloride is removed by pressure filtration.

The reaction product corresponds to the formula (III) in which j=153, m=2 and 1=3.07 and $R^2$ consists entirely of —$(CH_2)_3SH$ residues.

This produces an organopolysiloxane which consists to 99.34 mole % of units of the formula $$R_n^1SiO_{(4-n)/2}$$

and to 0.66 mole % of units of the formula $R^2SiO_{3/2}$

At the same time, n has the value of 2, $R^1$ consists to 0.22 mole % of residues of formula $—(CH_2)_3OSO_3\ominus$ and to 99.78 moles% of $—CH_3$ residues. $R^2$ has the above meaning. In this organopolysiloxane, there are 230.5 silicon atoms per anionic group.

Stable aqueous emulsions with active product contents of 1.0 to 50% can be prepared from the reaction product by known procedures using suitable emulsifiers, such as, for example, a nonylphenol ethylene oxide adduct.

EXAMPLE 4

Water (360 g) and 3.0 g of dodecylbenzene sulfonic acid are added to a reaction vessel and heated with stirring to 95° C. In order to synthesize the organopolysiloxane preparation, 167.0 g (0.56 moles) of octamethylcyclotetrasiloxane are now added from a dropping funnel to the emulsion solution and stirred vigorously for 60 minutes. Afterwards, the α,ω-polydimethylsiloxanediol, formed in the emulsion, is reacted with 5.61 g (0.015 moles) of a silane of formula $$(H_5C_2O)_2—\underset{\underset{CH_3}{|}}{Si}—(CH_2)_3—OSO_3\ominus . HN\oplus(C_2H_5)_3$$

and stirred once again for 30 minutes. 3-mercaptopropyltrimethoxysilane (2.95 g, 0.015 moles) is now added. The emulsion is stirred for a further 20 minutes and then cooled to 40° C. The acid contained in the emulsion is neutralized by the addition of 11 g of a 1-molar potassium hydroxide solution.

An aqueous preparation of an organopolysiloxane is obtained, which consists of 99.33 mole % of units of formula $$R_n^1SiO_{(4-n)/2}$$

and 0.67 mole % of units of formula $$R^2SiO_{3/2}.$$

In units of formula $R_n^1SiO_{(4-n)/2}$, 0.335 mole % of $R^1$ consists of residues of formula $—(CH_2)^2{}_3OSO_3\ominus$ and 99.665 mole % of $R^1$ are $—CH_3$ residues, n having the value of 2.

In the units of formula $R^2SiO_{3/2}$, 100 mole % of $R^2$ consists of $—(CH_2)_3—SH$ residues. There are 149.3 silicon atoms per anionic group.

EXAMPLE 5

(Comparison Example corresponding to German Offenlegungsschrift No. 23 65 977)

The following compounds were mixed:
Polydimethylsiloxane with terminal
≡Si—OH groups and a molecular weight of

| | |
|---|---|
| 45,000 (3,000 cSt.) | 90 parts by weight |
| $(CH_3O)_3Si(CH_2)_3NH(CH_2)_2NH_2$ | 5 parts by weight |
| Partial condensate of $CH_3Si(OCH_3)_3$ | 5 parts by weight |

An amount of this mixture, required for the preparation of the impregnating solution, is dissolved in toluene and diluted to the desired application concentration.

EXAMPLE 6

A material knitted from a fine wool is padded with the preparations prepared in Examples 1 to 5 in such a way that a solids add-on of 1% results when the impregnated knitted material is simply dried. In addition, the woolen material was also given a finishing treatment by the exhaust process with the preparation from Example 1 in a laboratory winch vat. When using a liquor of pH 4.5, the wool exhausted 100% of the active material. After drying, the add-on of active material in this case was 1%, based on the amount of woolen material used. After a 24-hour storage period at 20° C., finished as well as untreated material was washed in a domestic washing machine at 40° C. with addition of 5 g/l of Perox needle soap and 2 g/l of soda and tumble-dried between washings. The area shrinkage was determined after 10 such laundering treatments of 20 minutes each.

The area shrinkage was calculated according to the following formula:

$$\text{Area shrinkage} = \%\ L + \%\ W - (\%\ L \times \%\ W/100)$$

% L = percent shrinkage in length
% W = percent shrinkage in width

The following values were determined:

| | |
|---|---|
| Untreated material | 44% |
| Example 1, padding process | 1.8% |
| Example 1, exhaust process | 2.0% |
| Example 2, padding process | 2.0% |
| Example 3, padding process | 2.5% |
| Example 4, padding process | 3.0% |
| Example 5, padding process | 5.0% |

In contrast to the threaded materials, the unfinished sample has a highly felted surface. Moreover, the hand of the treated sample was significantly softer after laundering than the had of the untreated material after laundering and corresponded to the hand of the treated sample before laundering.

What is claimed is:

1. A composition for shrinkproofing wool comprising (a) 1 to 50 wt % of the following organopolysiloxanes:

(aa) 90 to 99.8 mole % of units having the formula $R_n^1SiO_{(4-n)/2}$ in which 90 to 100 mole % of $R^1$ is methyl, 0 to 10 mole % is longer chain alkyl residues with at most 18 carbon atoms or aryl residues, and 0 to 10 mole % is anionic groups linked through carbon atoms to the silicon atoms;

n has a value of 1.8 to 2.0; and (ab) 0.2 to 10 mole % of units of the formula $R^2SiO_{3/2}$ in which $R^2$ is alkyl, mercapto alkyl, mercapto aryl, hydrogen, $O_{0.5}$, or an anionic group linked through carbon atoms to the silicon atom, in which up to 10 mole % of oxygen atoms linked to silicon are each replaced by two $OR^3$ groups, in which $R^3$ is lower alkyl or hydrogen;

said organopolysiloxanes having at least one anionic group and containing 10 to 50 silicon atoms per anionic group, and (b) 50 to 99 wt % of water.

2. The composition of claim 1 which further contains conventional additives, emulsifiers, or organic solvents.

3. The composition of claim 1 wherein n is 2.

4. The composition of claims 1, 2 and 3 wherein the anionic groups have the formula $-R^4O_mSO_3^-$,

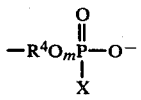

or $-R^4COO^-$, in which m is 0 or 1 and X is $-O^-$ or $-OR^3$, said anionic groups being present in the form of the acid or the totally or partly neutralized form and $R^4$ is a bivalent hydrocarbon residue, which may be interrupted by oxygen, nitrogen or sulfur atoms.

5. The composition of claims 1, 2 or 3, wherein the organopolysiloxanes contain 10 to 200 silicon atoms per anionic group.

6. The composition of claims 1, 2 or 3, wherein 95 to 99.8 mole % of (aa) units are present and 0.2 to 5 mole % of (ab) units are present.

7. The composition of claims 8, 2, or 3, wherein $R^2$ represents a mercaptoalkyl residue and all the anionic groups are linked to the (aa) units.

* * * * *